US006290332B1

(12) United States Patent
Crystal et al.

(10) Patent No.: US 6,290,332 B1
(45) Date of Patent: Sep. 18, 2001

(54) CARRIAGE ASSEMBLY FOR A LARGE FORMAT INK JET PRINT ENGINE

(75) Inventors: Kevin Reed Crystal, Chanhassan; Larry William Gonier, Inver Grove Heights; Aaron Gerald Barclay, Shokopee, all of MN (US)

(73) Assignee: Macdermid Acumen, Inc., Waterbury, CT (US)

( * ) Notice: Subject to any disclaimer, the term of this patent is extended or adjusted under 35 U.S.C. 154(b) by 0 days.

(21) Appl. No.: 09/252,375

(22) Filed: Feb. 18, 1999

(51) Int. Cl.[7] ..... B41J 2/01
(52) U.S. Cl. ..... 347/50; 347/49
(58) Field of Search ..... 347/8, 49, 50, 347/85, 86, 87, 102, 43

(56) References Cited

U.S. PATENT DOCUMENTS 5,646,665 * 7/1997 Swanson et al. ..... 347/87
5,696,541 * 12/1997 Akahane et al. ..... 347/8
5,953,028 * 9/1999 Nobel et al. ..... 347/50
6,022,104 * 2/2000 Lin et al. ..... 347/102

FOREIGN PATENT DOCUMENTS

09029982 * 4/1997 (JP) ..... B41J/2/16

* cited by examiner

*Primary Examiner*—Thinh Nguyen
*Assistant Examiner*—Anh T. N. Vo

(74) *Attorney, Agent, or Firm*—Woodcock Washburn Kurtz Mackiewicz & Norris LLP

(57) ABSTRACT

The disclosure concerns an apparatus that increases the utility of the ink jet printing engines by allowing the engine operator the freedom to select the spacing between the ink emitting nozzles of each inkjet print head and a printing substrate. The preferred embodiment of the present invention comprises a reciprocating carriage assembly having twelve individual ink jet pen receptacles and a manual vertical adjustment feature for precise control of the spacing between the printing substrate and the print head(s). In one embodiment, the inventive carriage assembly height adjustment features dual, manually-actuated axial screws that cooperate to evenly raise and lower the carriage assembly. Preferably a third mounting point ensures parallelism when the carriage assembly is raised and lowered. In use, the entire carriage assembly, including circuit boards, ink jet print heads, and electronics all move in unison when the axial shafts are rotated. A simple spacer tool, ground to a preselected thickness is used to confirm that an optimum head height has been reached, although other, more elaborate mechanisms could also be used. The inventive carriage assembly preferably includes a plurality of receptacles for receiving disposable ink jet print heads. Preferred features include a solderless assembly process, a tongue-in-groove coupling, and a first leaf spring to bias the print heads to precision mounting locations. Several elements cooperate to promote electrical contact between a flex circuit having mass terminations of electrical traces on the flex circuit and corresponding electrical features of each print head.

12 Claims, 8 Drawing Sheets

CARRIAGE ASSEMBLY FOR A LARGE FORMAT INK JET PRINT ENGINE

FIELD OF THE INVENTION

The present invention relates generally to the field printing. In particular, an improved reciprocating carriage apparatus for reliably and accurately retaining disposable ink jet cartridges, or pens, so that all the ink emitting nozzles of said pens can be registered in an ink jet print engine relative to one another and wherein the entire carriage can be articulated vertically to accommodate a variety of ink jet printing media of varying thickness while consistently maintaining an optimum spacing between the nozzles and the ink receiving surface of said printing media.

BACKGROUND OF THE INVENTION

The present invention addresses the issues related to consistently and accurately retaining a plurality of disposable ink jet pens in a pen receiving socket of a multi-head reciprocating carriage assembly. Many approaches of securing disposable ink jet pens have been tested and tried over the years and the driving concern has often been ease of use by the end user or operator of the print engine. Thus, while convenience in operation is required for consumer acceptance, as more and more ink jet pens have been added to ink jet print engines the difficulty in assembling the carriage and its associated pen retaining features have increased while at the same time the overall complexity of the pen retaining sockets and the carriage assembly itself have greatly increased.

In addition, an ever increasing variety of specialized ink jet printing substrates have been developed for a number of new niche markets, for example such as the so-called 'fine art' market characterized by relatively thick and non-compliant media. These new types of media often require specialized ink jet ink formulations for durability, lightfastness, and color fidelity all of which are improved when a common, optimum spacing between the ink emitting nozzles and the ink receiving surface of the media is maintained during printing operations. Accordingly, a need exists for ink print engines that can readily adapt to media of differing thickness as well as those print engines that have simple procedures for removing and accurately replacing ink jet pens with other ink jet pens containing, for example, new specialized formulations of ink jet ink. A need exists in the prior art to thus simplify the operation of changing ink jet pens, not only when faulty or expired, but also for convenience and so that the operator can utilize the vast variety of new ink formulations available now and in the future as well as rapidly re-set the spacing between the ink emitting nozzles and the printing substrate. Finally a need exists in the art to simplify assembly of the pen retaining sockets of the carriage assembly, and to reduce the number of parts and complexity of assembling a carriage assembly having a vertical adjustment relative to the printing substrate.

SUMMARY OF THE INVENTION

The apparatus of the present invention increases the utility of ink jet printing engines by allowing the engine operator the freedom to select the types of ink to be used and the spacing between the ink emitting nozzles and the printing substrate. The preferred embodiment of the present invention comprises a reciprocating carriage assembly having twelve (12) individual ink jet pen receptacles and a manual vertical adjustment feature so that precision control of critical printing parameters is easily practiced by print engine operators in the field. The inventive pen holder, or socket, employs a solderless assembly of parts, all retained by a simple tongue-in-groove style coupling for the a biasing leaf spring, a resilient base member, and a rubber pad which cooperate to promote electrical contact between a complex flex circuit having mass terminations of electrical traces on the flex and corresponding electrical features of a high resolution pen. The flex cable is retained in a rear portion of a pen receiving socket with a few post features (one having a lip feature to 'hang' the flex circuit in place during assembly) and is threaded through an aperture in the rear portion of each socket to create electrical communication between a pen disposed in the socket and a printed wiring board residing on the carriage assembly. Another leaf spring is friction fit over a side wall of the socket and biases the pen to points of location that correspond to tightly controlled tolerance locations on the pen body. A vertical bias force is preferably provided by one portion of a continuous spring that preferably provides a (downward) bias to a set of pens (i.e., six pens). The carriage head height adjustment feature taught herein features dual, manually-actuated axial screws that cooperate with a constrained screw to raise and lower the entire carriage assembly. This adjustment is practiced by simply turning one or both axial screws until a desired head height (spacing above a media residing on the platen) is reached. In the preferred embodiment, a backing plate rigidly attached to a trolley apparatus which reciprocates on a grooved rail in response to a tensioned driving belt is linked to what has heretofore been known as a traditional carriage assembly. Thus, the entire carriage assembly, including circuit boards, pen holders, electronics, and on board imaging devices (if any) all move in unison when the axial shafts are rotated. In this way, no additional wear, tolerances, or interference arises when the carriage is actuated. A simple spacer tool, ground to a preselected thickness is used to confirm that an optimum head height has been reached, although other, more elaborate mechanisms could also be used (much like a spark plug gap tool).

The following figures are not drawn to scale and only detail a few representative embodiments of the present invention, more embodiments and equivalents of the representative embodiments depicted herein are easily ascertainable by persons of skill in the digital imaging arts.

DESCRIPTION OF PREFERRED EMBODIMENT

Figure 2:
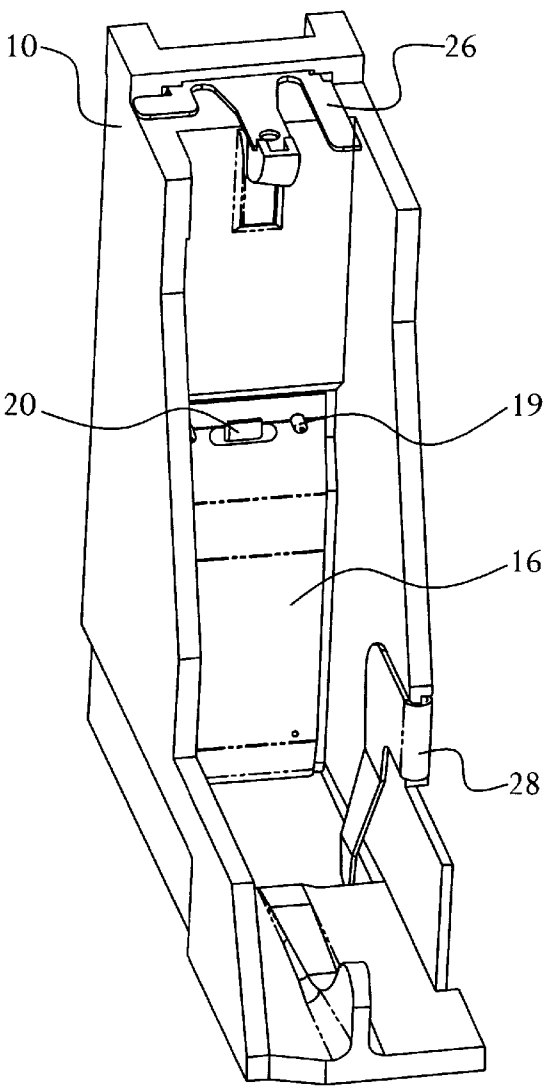
FIG. 2 is an elevational side view of the embodiment depicted in FIG. 1.

The present invention shall be generally described and the reader is invited and encouraged to fully inspect the Figures appended hereto, although the following description fairly describes the present invention, which is easily apprehended after review of the Figures and this summary. The preferred embodiment of the present invention comprises a reciprocating carriage assembly having twelve (12) individual ink jet pen receptacles and a manual vertical adjustment feature so that precision control of critical printing parameters is easily practiced by print engine operators in the field. The inventive pen holder, or socket, employs a solderless assembly of parts, all retained by a simple tongue-in-groove style coupling for the a biasing leaf spring, a resilient base member, and a rubber pad which cooperate to promote electrical contact between a complex flex circuit having mass terminations of electrical traces on the flex and corresponding electrical features of a high resolution pen. The flex cable is retained in a rear portion of a pen receiving socket with a few post features (one having a lip feature to 'hang' the flex circuit in place during assembly) and is threaded through an aperture in the rear portion of each socket to create electrical communication between a pen disposed in the socket and a printed wiring board residing on the carriage assembly. Another leaf spring is friction fit over a side wall of the socket and biases the pen to points of location that correspond to tightly controlled tolerance locations on the pen body. A vertical bias force is preferably provided by one portion of a continuous spring that preferably provides a (downward) bias to a set of pens (i.e., six pens). The carriage head height adjustment feature taught herein features dual, manually-actuated axial screws that cooperate with a constrained screw to raise and lower the entire carriage assembly. This adjustment is practiced by simply turning one or both axial screws until a desired head height (spacing above a media residing on the platen) is reached. In the preferred embodiment, a backing plate rigidly attached to a trolley apparatus which reciprocates on a grooved rail in response to a tensioned driving belt is linked to what has heretofore been known as a traditional carriage assembly. Thus, the entire carriage assembly, including circuit boards, pen holders, electronics, and on board imaging devices (if any) all move in unison when the axial shafts are rotated. In this way, no additional wear, tolerances, or interference arises when the carriage is actuated. A simple spacer tool, ground to a preselected thickness is used to confirm that an optimum head height has been reached, although other, more elaborate mechanisms could also be used (much like a spark plug gap tool).

The improved carriage apparatus 10 of the present invention is designed to electrically and physically support twelve (12) ink jet cartridges, or pens 14, in releasable engagement in a set of twelve pen sockets 12 which are disposed on a side of the carriage 10 so that when reciprocated across an articulated source of printing media, ink is emitted from a plurality of ink emitting nozzles disposed on a lower surface of said pens 14. The releasable engagement allows the operator of the print engine the freedom to select the types of ink to be used for a given print job although each time a pen 14 is removed from its respective socket 12 registration and calibration of the pens 14 is typically required. To assist the accuracy of placement of the pens 14 in the sockets 12 of the carriage assembly a discrete set of structures are used.

Figure 1:
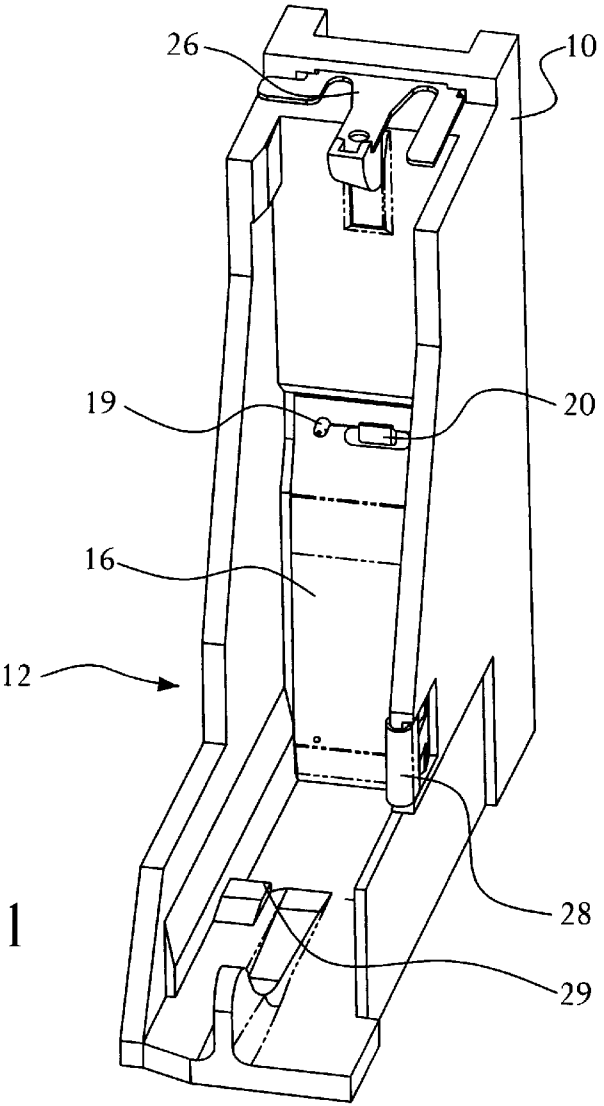
FIG. 1 depicts a plan view of an embodiment of the present invention designed to accommodate dual linear arrays of six discrete ink jet print heads.
Figure 10:
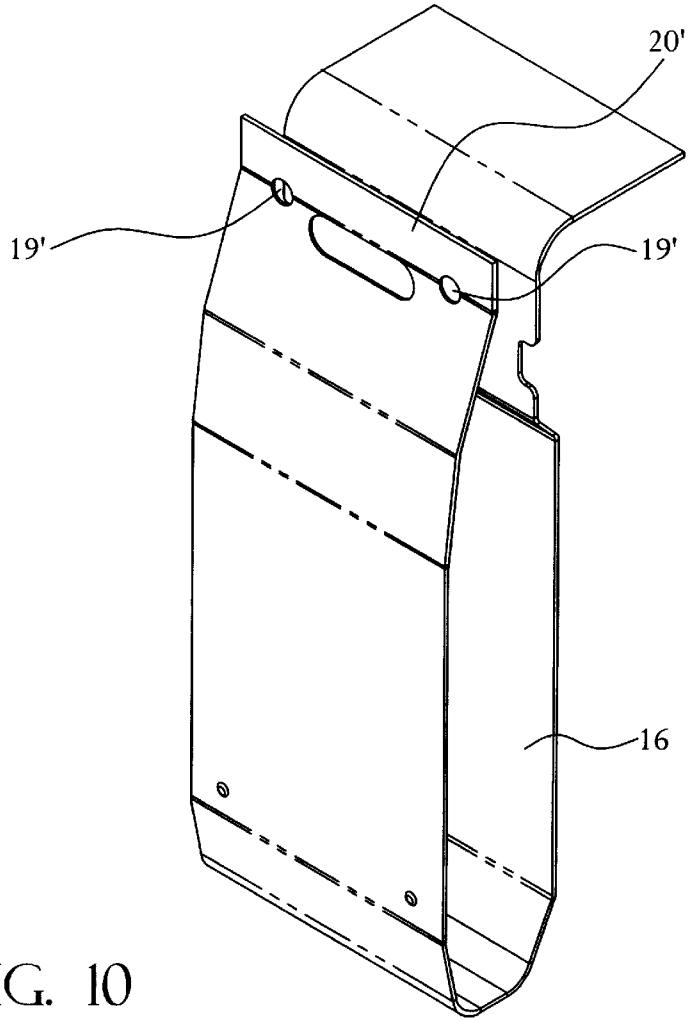
FIG. 10 depicts a perspective view of an exemplary flex circuit in accordance with the present invention.

Referring to FIG. 1 and FIG. 2, which are both perspective views of a socket 12 for receiving a pen 14 the structures are shown in detail. A flex circuit 16 is threaded through an aperture (not shown) in the back of the socket 12 where it is supported on two posts 19 and a hook member 20 that correspond to apertures 19' and 20' of the flex circuit 16 (FIG. 10). The posts 19 and hook member 20 cooperate to retain the flex circuit during assembly, and during removal and replacement of pens 14 from the socket 12. A side bias force is generated by spring 28 which is a modified leaf spring which urges a pen 14 located in the socket 12 toward an accurately toleranced, and located datum 29 which corresponds to a similarly precise physical feature of the preferred pen 14 for use with the present invention. The preferred pen for use is manufactured by Hewlett-Packard Company of Palo Alto, Calif. and is known as the "Hercules" cartridge (model number 1809A). A top spring member 26 provides a downward bias to the pen 14 and in a preferred embodiment, top spring member 26 comprises a serpentine metal member that is situated in a horizontal slot formed at the top of each socket 12. In the embodiment depicted, an end member formed of resin is attached to a cantilevered end of the top spring and the end member cooperates with structure present on the preferred pen 14 as described.

Figure 4:
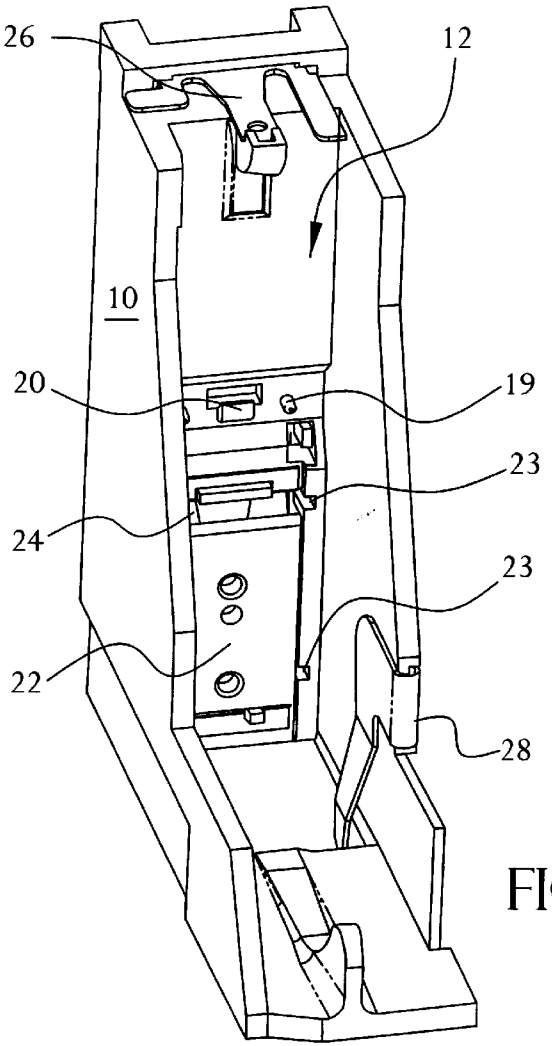
FIG. 4 depicts an embodiment of the present invention wherein corresponding peg members are disposed on a carriage assembly so that they cooperate with the grooved channel members of the service station platform.
Figure 3:
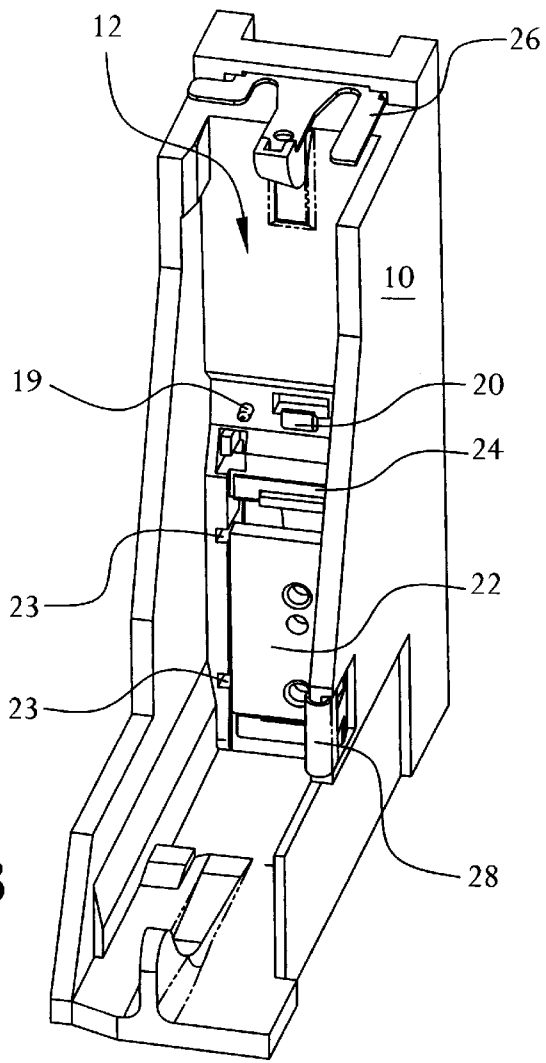
FIG. 3 is an enlarged view of one of the grooved channel members depicts is FIG. 1 and FIG. 2 taken along the line 3—3 of FIG. 2.

Referring to FIG. 3 and FIG. 4, which depict similar perspective views as shown in FIGS. 1 and 2 with the exception that the flex circuit 16 has been removed to assist the clarity of the description herein, further supporting structure for supporting a pen 14 is releasable engagement in the socket 12. A backing spring 24 which as will be seen is a thin metallic leaf spring and journals formed at the ends to engage structure within the socket 12, is disposed in the socket 12 and buttresses a plate member 22 having a set of four pins extending from the periphery thereof (not shown) which engage a set of channels 23 formed in the socket 12. The plate member 22 has a couple of apertures formed therein which are designed to receive elastic bosses from a rubber pad 18 (not shown). Together the backing spring 24, the plate member 22, and the rubber pad 18 form a distributed biasing force against a pen 14 which is engaged in the socket 12.

Figure 6:
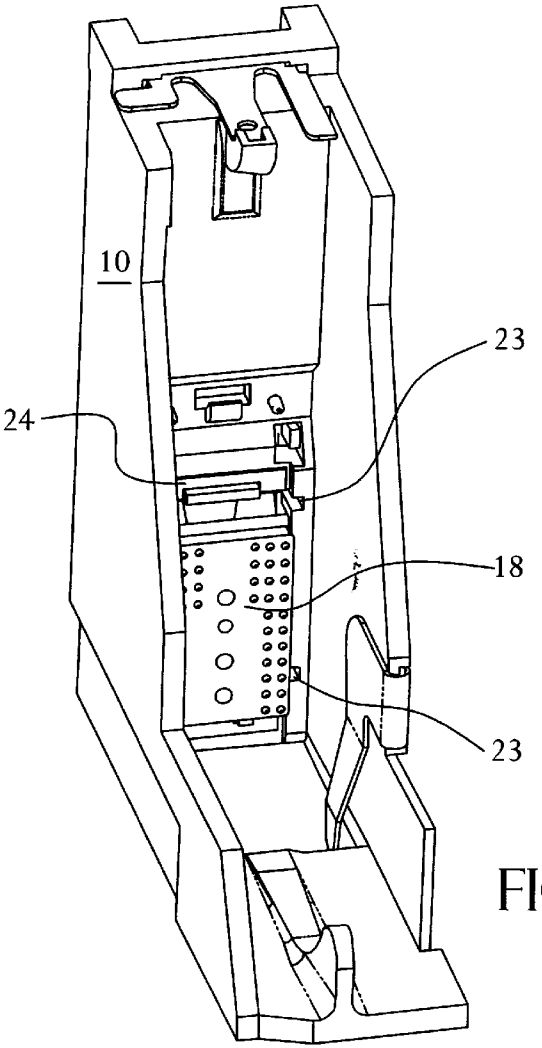
FIG. 6 depicts an embodiment of the present invention wherein the location of the peg members and the grooved channel members is offset between the carriage assembly and the service station platform.
Figure 5:
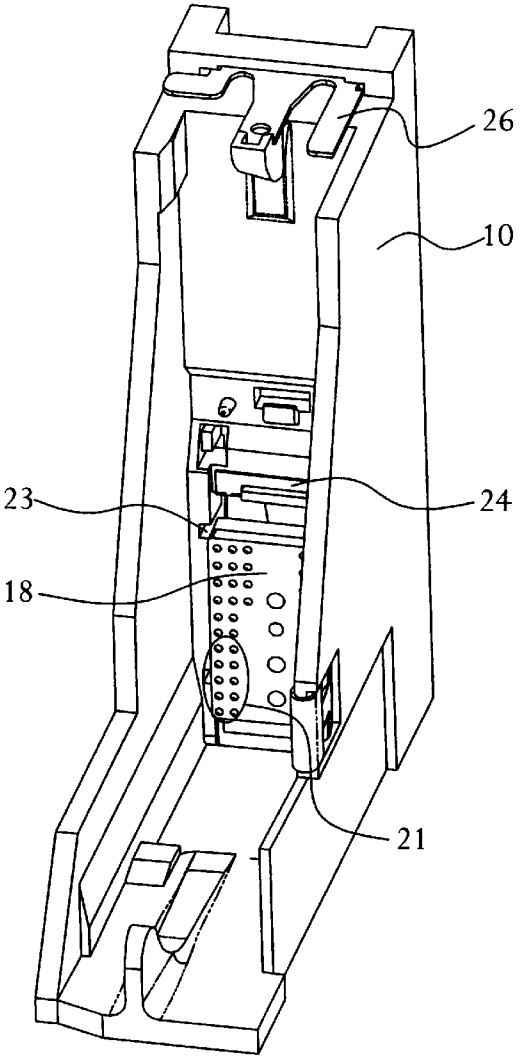
FIG. 5 depicts an embodiment of the present invention wherein a spring bias force replaces the third of the at least three peg/channel sets.

Referring to FIG. 5 and FIG. 6, depicts similar perspective views as shown in FIGS. 1,2 and FIGS. 3,4 with the exception that the flex circuit 16 has been removed and the rubber pad 18 has been added to assist the clarity of the description herein. In these views, the channels 23, backing spring 24, and the rubber pad 18 are shown as they appear during assembly. Part of the utility of the present invention directly relates to the ease of assembly and the lack of tolerance stack up which can cause mis-positioning of a pen 14 in a socket 12. The rubber pad 18 preferably has a set of bosses 21 that promote electrical contact between the flex circuit 16 and electrical termination posts of the pen 14 when assembled and populated by pens 14.

Figure 7:
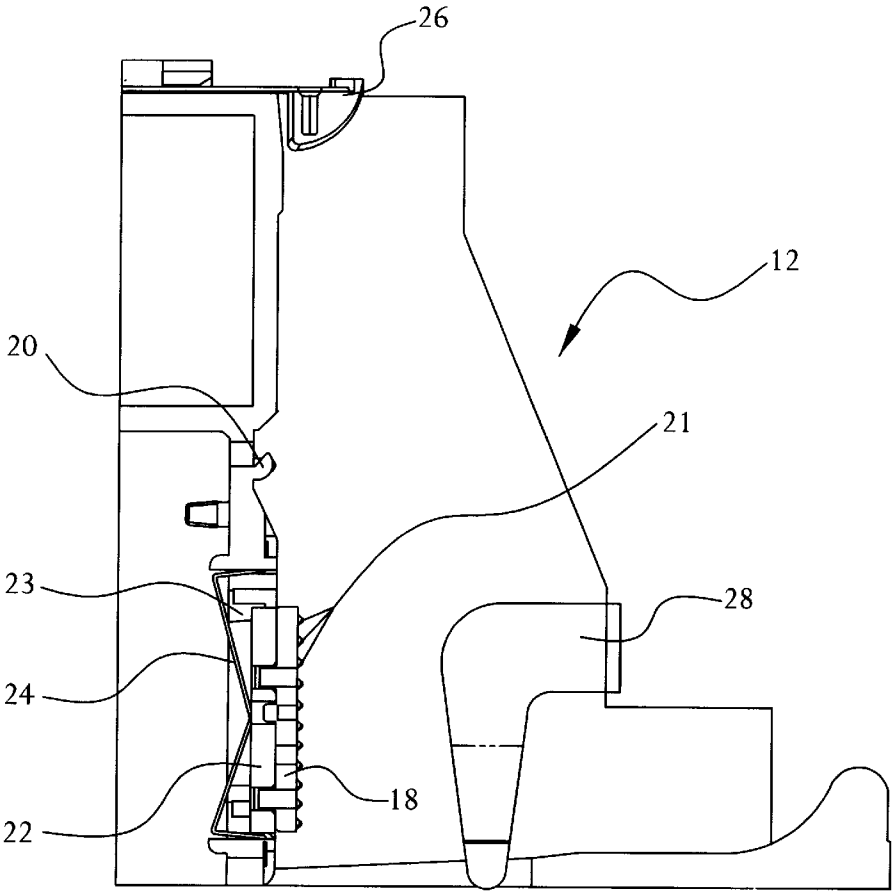
FIG. 7 depicts an exemplary elevation view in cross section of the structure of FIGS. 5 and 6 in an assembled state.

Referring to FIG. 7, an elevational view in cross section, the structures just described as depicted in an assembled state (although without the flex circuit 16), including the channels 23 which receive the pins 25 of the plate member 22, the backing spring 24, the side spring 24, and the top spring 26 (with end).

Figure 9:
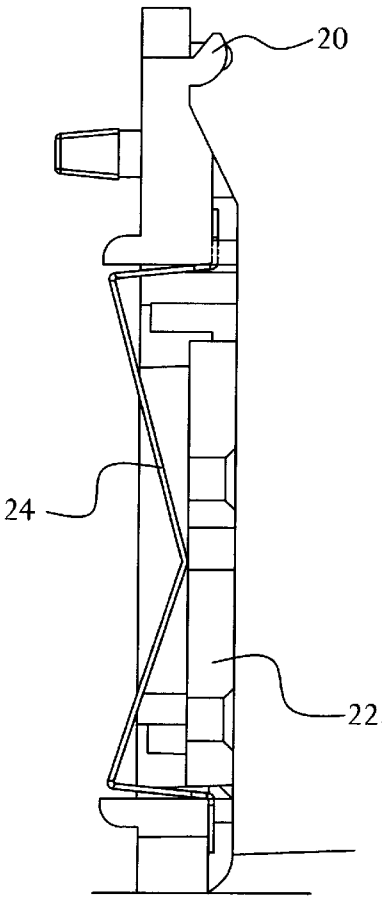
FIG. 9 depicts another enlarged view of an exemplary backing spring.
Figure 8:
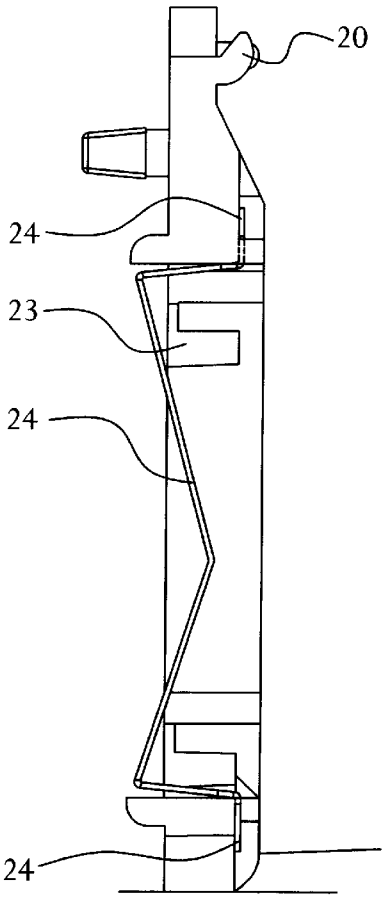
FIG. 8 depicts an enlarged view of an exemplary backing spring.

Referring to FIG. 8 and FIG. 9 which are enlarged views of the backing spring 24, plate member 22, and grooves 23, the detail of the solderless engagement grooves and the corresponding structured ends of the backing spring 24 are shown. Further, the hook member 20 is shown in relief (without the flex circuit 16 in place).

FIG. 10 is a perspective view of the preferred flex circuit 16 of the present invention depicted in the form taken when assembled wherein post aperture 19' and hook aperture 20' are also depicted.

Figure 11:
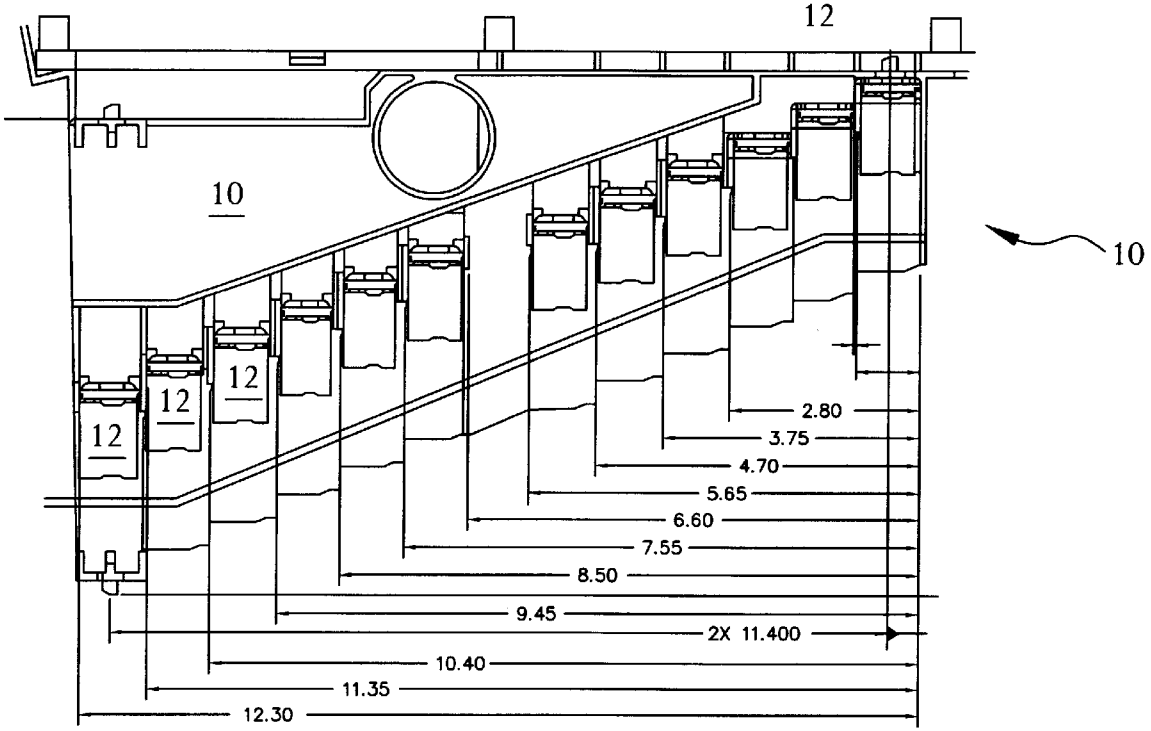
FIG. 11 depicts a plan view of an exemplary twelve pen carriage of the present invention illustrating the off-set orientation of the pen sockets.

FIG. 11 is a plan view of the twelve (12) pen 14 carriage 10 of the present invention illustrating the off-set, or staggered, orientation of the pen sockets 12.

Figure 12:
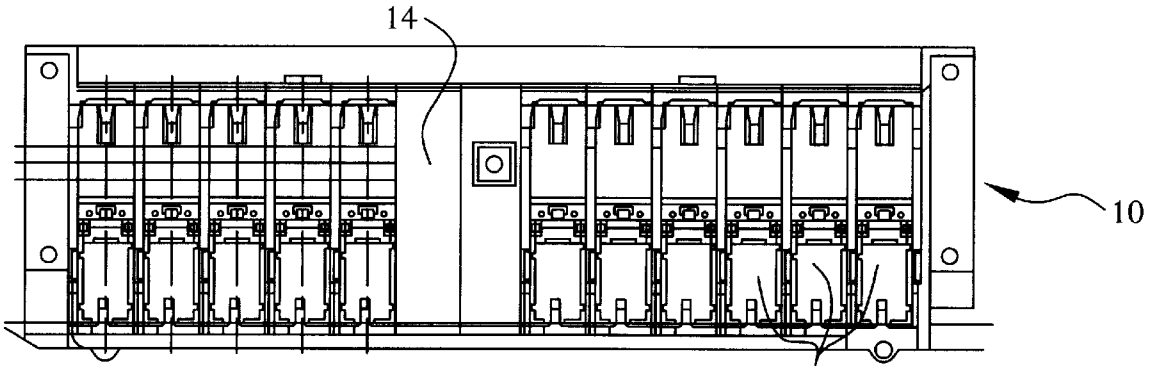
FIG. 12 depicts an elevation side view of an exemplary carriage showing a pen located in one of the sockets and showing the tightly packed orientation of the pen socket.

FIG. 12 is a elevational side view of the carriage 10 showing a pen 14 located in socket 12 and showing the tightly packed orientation of the pen sockets 12.

Figure 13A:
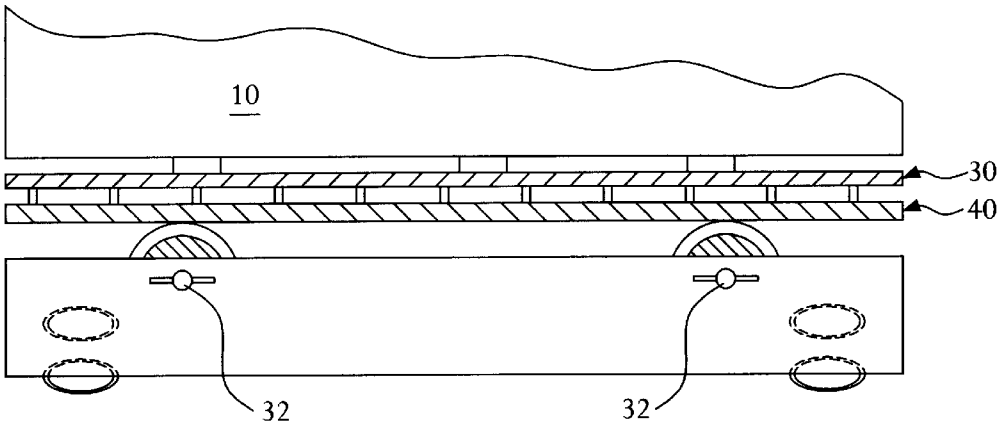
FIGS. 13A and 13B depict two views of an exemplary vertical carriage articulation faculty for the carriage for an embodiment wherein a trolley is coupled to an axial rail and is driven back and forth during printing.
Figure 13B:
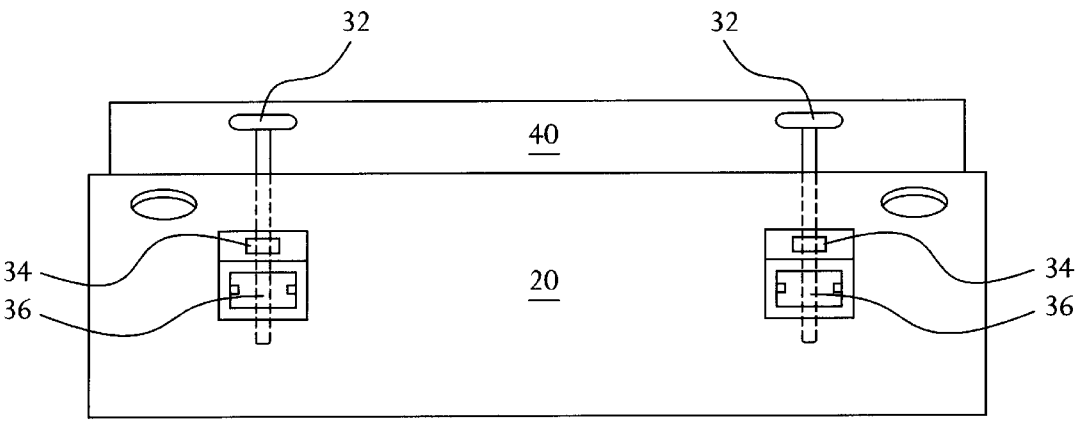

FIG. 13A and FIG. 13B are two views of a vertical carriage articulation faculty for the carriage 10 wherein a trolley 20 which couples to an axial rail (not shown) and is driven back and forth during printing. The trolley 20 couples to a backing plate 40 which is mechanically fasted to the carriage assembly 10. The trolley 20 is preferably fastened to the backing plate with a simple threaded screw 32 which can be manually operated to raise and lower the backing plate 40, and thus, the carriage 10 and ultimately, the pens 14. The threaded screw 32 preferably engages a fixed nut 34 which is free to rotate and thereby imparts the raising and lowering movement to the backing plate 40. The backing plate 40 is mechanically fastened to the trolley with a threaded fitting member 36 which is grasped with two (bent) flange members formed out of the backing plate 40 and which acts as a hard stop so that the threaded screw 32 is turned the fitting member 36 abuts a frame portion. Presently this 'hard stop' is provided after a total travel distance of approximately one eight of an inch (⅛") although different amounts of travel can be designed without departing from the teaching herein. The trolley is supported on the rail via a set of trolley wheels 38 (shown partially in FIG. 13). The backing plate 40 directly couples to the carriage 10 (including the circuit board 30) so that the trolley remains on the track while the rest of the assembly can be raised and lowered conveniently. A spacer tool (feeler gauge-type) can be used for 'calibration' of an optimum head height setting and is simply placed on the surface of a media and the threaded screws turned until slight friction is felt when the spacer tool is removed. If more than one 'head height' setting is desired, the spacer tool can simply have more locations of varying thickness (and corresponding indicia as to height—or type of media settings) so the end user can quickly and readily set an optimum head height (at both ends of the carriage) and continue printing.

Although that present invention has been described with reference to discrete embodiments, no such limitation is to be read into the claims as they alone define the metes and bounds of the invention disclosed and enabled herein. One of skill in the art will recognize certain insubstantial modifications, minor substitutions, and slight alterations of the apparatus and method claimed herein, that nonetheless embody the spirit and essence of the claimed invention without departing from the scope of the following claims.

What is claimed is:

1. An improved reciprocating carriage apparatus for releasably retaining a plurality of an ink jet print heads, wherein the carriage assembly has a plurality of pen sockets formed in staggered formation on a side of the carriage, the improvement comprising:

a backing spring disposed in a cavity of a pen socket to create a y-direction force;

a plate member disposed on top of the backing spring, wherein the plate member has four pins extending outward slidingly engaged in a set of channels formed in the pen socket;

a rubber pad in contact with the plate member;

a flex circuit having a hook aperture and at least two post apertures formed in one end disposed on top of the plate member;

a side bias spring disposed to create an x-direction force;

a top spring disposed to create a negative z-direction force; and a multifaceted datum formed on a portion of the pen socket for receiving the x-direction force, the y-direction force, and the z-direction forces.

2. The apparatus of claim 1, further comprising a head height adjustment means for raising and lowering the carriage.

3. An improved reciprocating carriage apparatus for releasably retaining a plurality of ink jet print heads, wherein the carriage apparatus has a plurality of pen sockets formed in staggered formation on a side of the carriage, the improvement comprising:

a backing spring disposed in a cavity of a pen socket to create a y-direction force;

a plate member disposed on top of the backing spring, wherein the plate member has four pins extending outward slidingly engaged in a set of channels formed in the pen socket;

a rubber pad in contact with the plate member;

a flex circuit having a hook aperture and at least two post apertures formed in one end disposed on top of the plate member;

a side bias spring disposed to create an x-direction force;

a top spring disposed to create a negative z-direction force;

a datum formed on a portion of the pen socket for receiving the x-direction force, the y-direction force, and the z-direction forces; and a head height adjustment means having at least one threaded screw and a trolley member that remains stationary while the carriage apparatus articulates upward and downward when the at least one threaded screw is rotated.

4. The apparatus of claim 3, wherein the plurality of ink jet print heads is twelve ink jet print heads.

5. The apparatus of claim 3, wherein the pen socket is at least ten pen sockets arranged in a staggered array so that no two pen sockets directly oppose the same horizontal portion of a printing platen adjacent to the carriage.

6. The apparatus of claim 3, wherein each of said plurality of heads is a high resolution ink jet head wherein each said high resolution ink jet head has at least 250 ink emitting nozzles.

7. The apparatus of claim 3, wherein the pen socket has two post members and a hook member disposed above the spring member so that the flex circuit aperture mount thereon.

8. An improved carriage assembly for retaining a set of ink jet print heads disposed therein, comprising:

a backing spring disposed in a cavity of a pen socket to create a y-direction force;

a plate member disposed on top of the backing spring, wherein the plate member has a set of pins extending outward which are engaged in a set of channels formed in the pen socket due to the force provided by the backing spring;

a rubber pad in contact with the plate member;

a flex circuit having a hook aperture and at least two post apertures formed in one end disposed on top of the plate member;

a side bias spring disposed to create an x-direction force;

a top spring disposed to create a negative z-direction force; and a datum formed on a portion of the pen socket for receiving the x-direction force, the y-direction force, and the z-direction forces.

9. An improved carriage assembly for retaining a set of ink jet print heads disposed therein, comprising:

a backing spring disposed in a cavity of a pen socket to create a y-direction force;

a plate member disposed on top of the backing spring, wherein the plate member has a set of pins extending outward which are engaged in a set of channels formed in the pen socket due to the force provided by the backing spring;

a rubber pad in contact with the plate member;

a flex circuit having a hook aperture and at least two post apertures formed in one end disposed on top of the plate member;

a side bias spring disposed to create an x-direction force;

a top spring disposed to create a negative z-direction force; and a datum formed on a portion of the pen socket for receiving the x-direction force, the y-direction force, and the z-direction forces; and wherein the head height adjustment means is at least one threaded screw and wherein a trolley member remains stationary while the carriage assembly articulates upward and downward when the at least one threaded screw is rotated.

10. The apparatus of claim 9, wherein the plurality of ink jet print heads is twelve ink jet print heads.

11. The apparatus of claim 9, wherein each of said plurality of heads is a high resolution ink jet head wherein each said high resolution ink jet head has at least 250 ink emitting nozzles.

12. The apparatus of claim 9, wherein the pen socket is at least ten pen sockets arranged in a staggered array so that no two pen sockets directly oppose the same horizontal portion of a printing platen adjacent to the carriage.

* * * * *